US011566636B2

(12) United States Patent
Yamada

(10) Patent No.: US 11,566,636 B2
(45) Date of Patent: Jan. 31, 2023

(54) SUSPENDING TOOL, SUPPORTING JIG, DISASSEMBLING METHOD FOR ROTARY MACHINE, AND ASSEMBLING METHOD FOR ROTARY MACHINE

(71) Applicant: MITSUBISHI HEAVY INDUSTRIES COMPRESSOR CORPORATION, Tokyo (JP)

(72) Inventor: Hideki Yamada, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 0 days.

(21) Appl. No.: 17/202,902

(22) Filed: Mar. 16, 2021

(65) Prior Publication Data

US 2021/0324877 A1 Oct. 21, 2021

(30) Foreign Application Priority Data

Apr. 20, 2020 (JP) ..... JP2020-074871

(51) Int. Cl.

| | |
|---|---|
| ***F01D 25/28*** | (2006.01) |
| ***F04D 29/62*** | (2006.01) |
| ***F04D 17/12*** | (2006.01) |

(52) U.S. Cl.

CPC ..... *F04D 29/624* (2013.01); *F01D 25/285* (2013.01); *F04D 17/125* (2013.01); *F05D 2220/31* (2013.01); *F05D 2230/68* (2013.01); *F05D 2230/70* (2013.01); *F05D 2260/02* (2013.01)

(58) Field of Classification Search

CPC ..... F04D 29/624; F05D 2220/31; F05D 2230/70; F05D 2230/68; F05D 2260/02; F01D 25/285

See application file for complete search history.

(56) References Cited

U.S. PATENT DOCUMENTS

| | | | | |
|---|---|---|---|---|
| 10,184,357 | B2 * | 1/2019 | Mane | F01D 25/285 |
| 10,364,820 | B1 * | 7/2019 | Oda | F04D 29/622 |

(Continued)

FOREIGN PATENT DOCUMENTS

| | | | |
|---|---|---|---|
| EP | 3770441 | A1 | 1/2021 |
| JP | 2013-072356 | A | 4/2013 |

(Continued)

*Primary Examiner* — Courtney D Heinle
*Assistant Examiner* — Andrew J Marien
(74) *Attorney, Agent, or Firm* — Osha Bergman Watanabe & Burton LLP

(57) ABSTRACT

A suspending tool includes a suspending tool main body that extends to be parallel with an axial direction above a rotor main body, a pair of bearing supporting portions that are disposed at an interval in the axial direction and are detachable from the bearing portions, a pair of seal supporting portions that are disposed inside the pair of bearing supporting portions in the axial direction at an interval in the axial direction and are detachable from the seal portions, and a plurality of diaphragm supporting portions that are disposed inside the pair of seal supporting portions in the axial direction such that the diaphragm supporting portions are disposed at intervals in the axial direction and are detachable from the diaphragms.

2 Claims, 10 Drawing Sheets

(56) References Cited

U.S. PATENT DOCUMENTS

| | | | | |
|---|---|---|---|---|
| 2007/0033795 | A1* | 2/2007 | McCaffrey | B66C 11/12 29/559 |
| 2014/0178183 | A1 | 6/2014 | Masuda et al. | |
| 2015/0337685 | A1* | 11/2015 | Golubic | F01D 25/28 415/214.1 |
| 2017/0030377 | A1* | 2/2017 | Huth | F04D 29/444 |
| 2020/0011205 | A1* | 1/2020 | Sasaki | B66C 1/42 |

FOREIGN PATENT DOCUMENTS

| | | | |
|---|---|---|---|
| JP | 2020-007956 | A | 1/2020 |
| WO | 2019-207761 | A1 | 10/2019 |

* cited by examiner

SUSPENDING TOOL, SUPPORTING JIG, DISASSEMBLING METHOD FOR ROTARY MACHINE, AND ASSEMBLING METHOD FOR ROTARY MACHINE

BACKGROUND OF THE INVENTION

Field of the Invention

The present disclosure relates to a suspending tool, a supporting jig, a disassembling method for a rotary machine, and an assembling method for a rotary machine.

Priority is claimed on Japanese Patent Application No. 2020-074871, filed on Apr. 20, 2020, the content of which is incorporated herein by reference.

Description of Related Art

A rotary machine such as a centrifugal compressor and a steam turbine includes a rotor that rotates about an axis and a casing that covers the rotor. The rotor includes a rotor main body extending in an axial direction parallel with an axis and a plurality of impellers disposed on the rotor main body. In such a rotary machine, a casing has a structure that is vertically dividable into an upper half casing and a lower half casing in some cases. At the time of maintenance or replacement of the rotor, the upper half casing is removed from the lower half casing so that an upper half portion of the rotor is exposed. Thereafter, the rotor is lifted up to be extracted from the lower half casing and maintenance or replacement of the rotor is performed.

In addition, in the case of a structure in which the casing is divided into upper and lower parts, a plurality of diaphragms covering the impellers are disposed inside the casing. The plurality of diaphragms are disposed independently of each other in the axial direction. Therefore, at the time of maintenance that requires disassembly or assembly, a large amount of work time is required to disassemble or assemble each of the plurality of diaphragms. With regard to this, a rotary machine, in which components including diaphragms is handled as an internal unit and is handled as one component so as to remove a plurality of diaphragms from the casing in a short time, is described in Japanese Unexamined Patent Application, First Publication No. 2013-72356. In such a structure, it is possible to collectively move the internal unit with respect to the lower half casing.

SUMMARY OF THE INVENTION

However, in the case of the structure as described in Japanese Unexamined Patent Application, First Publication No. 2013-72356, it is necessary to adopt a structure in which a plurality of components can be fixed to each other in advance in order to form an internal unit. That is, in the case of the structure as described in Japanese Unexamined Patent Application, First Publication No. 2013-72356, it is not possible to collectively move components if the rotary machine does not have a structure in which the components can be fixed to each other in advance. Therefore, there is a problem that it is desired to reduce the labor or time it takes to disassemble or assemble a rotary machine including internal components not fixed to each other.

The present disclosure provides a suspending tool, a supporting jig, a disassembling method for a rotary machine, and an assembling method for a rotary machine with which it is possible to improve the efficiency of a maintenance operation with respect to a rotary machine including internal components not fixed to each other.

According to an aspect of the present disclosure, there is provided a suspending tool from which an internal unit of a rotary machine is configured to suspend, the internal unit including a rotor main body that extends in an axial direction, a plurality of impellers that are disposed at intervals in the axial direction and are fixed to an outer side of the rotor main body in a radial direction, a pair of seal portions that are disposed at a first end and a second end of the rotor main body at an interval in the axial direction, are disposed outside the rotor main body in the radial direction, and have an annular shape, a pair of bearing portions that are disposed outside the pair of seal portions in the axial direction, and a plurality of diaphragms that are disposed to be arranged in the axial direction and respectively cover the plurality of impellers from an outer side in the radial direction and the suspending tool including a suspending tool main body that is configured to extend to be parallel with the axial direction above the rotor main body, a pair of bearing supporting portions that are disposed at an interval in the axial direction, are connected to the suspending tool main body, and are detachable from the bearing portions, a pair of seal supporting portions that are disposed inside the pair of bearing supporting portions in the axial direction at an interval in the axial direction, are connected to the suspending tool main body, and are detachable from the seal portions, and a plurality of diaphragm supporting portions that are disposed inside the pair of seal supporting portions in the axial direction such that the diaphragm supporting portions are disposed at intervals in the axial direction, are connected to the suspending tool main body, and are detachable from the diaphragms.

According to another aspect of the present disclosure, there is provided a supporting jig including a suspending tool as described above and a supporting base that is configured to support the internal unit suspended from the suspending tool from below. The supporting base includes a base and a unit supporting portion that is fixed to the base and is configured to support the seal supporting portions from below and to which the seal supporting portions are detachably connected.

According to still another aspect of the present disclosure, there is provided a disassembling method for a rotary machine in which a rotary machine, which includes a casing including a lower half casing and an upper half casing disposed above the lower half casing and in which the internal unit is disposed inside the casing, is disassembled by using the suspending tool as described above, the disassembling method including a step of exposing an upper half portion of the internal unit on the lower half casing by removing the upper half casing, a step of disposing the suspending tool above the internal unit of which the upper half portion is exposed, a step of attaching the suspending tool to the internal unit by fixing the pair of bearing supporting portions to the pair of bearing portions respectively, fixing the pair of seal supporting portions to the pair of seal portions respectively, and fixing the plurality of diaphragm supporting portions to the plurality of diaphragms respectively after the suspending tool is disposed above the internal unit, and a step of removing the internal unit from the lower half casing by lifting up the suspending tool attached to the internal unit.

According to still another aspect of the present disclosure, there is provided an assembling method for a rotary machine in which a rotary machine, which includes a casing including a lower half casing and an upper half casing disposed above the lower half casing and in which the internal unit is disposed inside the casing, is assembled by using the suspending tool as described above, the assembling method including a step of disposing the suspending tool above the internal unit, a step of attaching the suspending tool to the internal unit by fixing the pair of bearing supporting portions to the pair of bearing portions respectively, fixing the pair of seal supporting portions to the pair of seal portions respectively, and fixing the plurality of diaphragm supporting portions to the plurality of diaphragms respectively after the suspending tool is disposed above the internal unit, a step of lifting up the suspending tool attached to the internal unit and accommodating the internal unit in the lower half casing, and a step of attaching the upper half casing onto the lower half casing.

With a suspending tool, a supporting jig, a disassembling method for a rotary machine, and an assembling method for a rotary machine according to the present disclosure, it is possible to improve the efficiency of a maintenance operation with respect to a rotary machine including internal components that cannot be fixed to each other.

DETAILED DESCRIPTION OF THE INVENTION

Hereinafter, an embodiment of a suspending tool, a supporting jig, a rotary machine disassembling method, and a rotary machine assembling method according to the present disclosure will be described with reference to FIGS. 1 to 10. However, the present disclosure is not limited only to this embodiment.

(Configuration of Rotary Machine)

Figure 1:
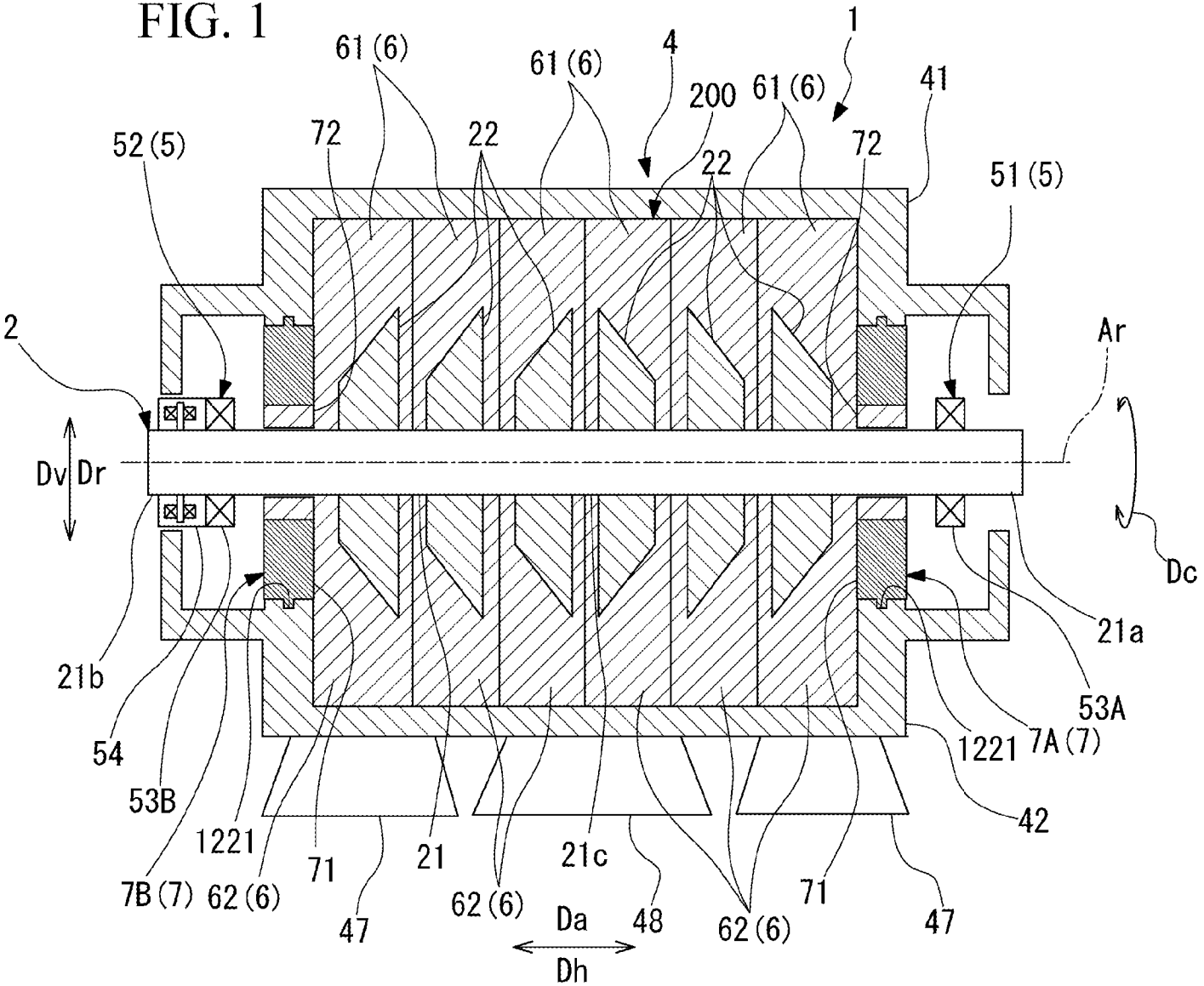
FIG. 1 is a sectional view showing a schematic configuration of a rotary machine according to an embodiment.

First, a rotary machine to which a suspending tool, a supporting jig, a rotary machine disassembling method, and a rotary machine assembling method according to the present embodiment is applied will be described. A rotary machine 1 mainly includes a rotor 2, a casing 4, bearing portions 5, diaphragms 6, and seal portions 7, as shown in FIG. 1. In the present embodiment, the rotary machine 1 is, for example, a multi-stage centrifugal compressor.

(Configuration of Rotor)

The rotor 2 is rotatable around an axis Ar in the casing 4. The rotor 2 includes a rotor main body 21 and impellers 22. The rotor main body 21 extends in an axial direction Da while being centered on the axis Ar. The rotor main body 21 is supported by the bearing portions 5 such that the rotor main body 21 can rotate about the axis Ar.

Note that, hereinafter, a direction in which the axis Ar extends will be referred to as the axial direction Da. A vertical direction orthogonal to the axial direction Da will be referred to as a vertical direction Dv. That is, the axial direction Da in the rotary machine 1 is one of horizontal directions Dh. A plane orthogonal to the vertical direction Dv is a horizontal plane. The axial direction Da of the rotor main body 21 is parallel with the horizontal plane. Radial directions with respect to the axis Ar will be simply referred to as radial directions Dr. One of the radial directions Dr that is orthogonal to the vertical direction Dv will be referred to as a width direction Dw which is one of the horizontal directions Dh. In addition, a direction around the rotor 2 centered on the axis Ar will be referred to as a circumferential direction Dc.

A plurality of the impellers 22 are disposed at intervals in the axial direction Da. The impellers 22 are fixed to an outer side of the rotor main body 21 in the radial directions Dr. Each impeller 22 can rotate integrally with the rotor main body 21 around the axis Ar. In the present embodiment, six impellers 22 are disposed in total, for example. The impellers 22 are disposed such that the impellers 22 on a side close to a first end 21*a* of the rotor main body 21 (first end 21*a* side) and the impellers 22 on a side close to a second end 21*b* of the rotor main body 21 (second end 21*b* side) are symmetrical with respect to a central portion 21*c* of the rotor main body 21 in the axial direction Da. Three impellers 22 are disposed on each of the first end 21*a* side and the second end 21*b* side with respect to the central portion 21*c* of the rotor main body 21 such that the impellers 22 on the first end 21*a* side and the impellers 22 on the second end 21*b* side are disposed back to back.

In the present embodiment, an external shaft (not shown), which is rotationally driven around the axis Ar by another rotary machine (not shown) disposed outside the casing 4, is detachably connected to the first end 21*a* of the rotor main body 21.

Note that, the number of the impellers 22 disposed at the rotor main body 21 and the orientations of the impellers 22 are not limited to those described above and can be appropriately changed.

(Configuration of Casing)

The casing 4 has a tubular shape that extends in the axial direction Da while being centered on the axis Ar. In the casing 4, suction ports 47 through which a working fluid is introduced into the casing 4 and a discharge port 48 through which the working fluid is discharged to the outside of the casing 4 are formed. The casing 4 accommodates the rotor 2 together with the diaphragms 6. The casing 4 includes an upper half casing 41 and a lower half casing 42, the upper half casing 41 being on an upper side with respect to the axis Ar of the rotor 2 and the lower half casing 42 being on a lower side with respect to the axis Ar of the rotor 2.

The upper half casing 41 extends in the circumferential direction Dc. A section of the upper half casing 41 that is orthogonal to the axis Ar has a semi-annular shape centered on the axis Ar. The upper half casing 41 is open toward a lower side in the vertical direction Dv such that the rotor 2 and upper half diaphragms 61 can be accommodated. The upper half casing 41 includes parting surfaces (upper half casing parting surfaces) at both ends in the circumferential direction Dc. The parting surfaces of the upper half casing 41 are horizontal surfaces facing the lower side in the vertical direction Dv.

The lower half casing 42 extends in the circumferential direction Dc. A section of the lower half casing 42 that is orthogonal to the axis Ar has a semi-annular shape centered on the axis Ar. The inner diameter of the lower half casing 42 is the same as the inner diameter of the upper half casing 41. The lower half casing 42 is open toward an upper side in the vertical direction Dv such that the rotor 2 and lower half diaphragms 62 can be accommodated. The lower half casing 42 includes parting surfaces (lower half casing parting surfaces) at both ends in the circumferential direction Dc. The parting surfaces of the lower half casing 42 are horizontal surfaces facing the upper side in the vertical direction Dv. The upper half casing 41 is disposed above the lower half casing 42 in the vertical direction Dv. The upper half casing 41 and the lower half casing 42 are fixed to each other via a fastening member such as a bolt or the like (not shown) in a state where the parting surfaces thereof are in contact with each other. In this manner, the casing 4 is formed.

(Configuration of Diaphragm)

The diaphragms 6 are disposed on the outer side of the rotor main body 21 in the radial directions Dr. A plurality of the diaphragms 6 are disposed to be arranged in the axial direction Da such that the diaphragms 6 correspond to the impellers 22 respectively. Each diaphragm 6 has a ring shape centered on the axis Ar. The ring-shaped diaphragms 6 include the upper half diaphragms 61 and the lower half diaphragms 62, the upper half diaphragms 61 being on the upper side in the vertical direction Dv with respect to the axis Ar of the rotor 2 and the lower half diaphragms 62 being on the lower side in the vertical direction Dv with respect to the axis Ar of the rotor 2. The upper half diaphragms 61 are fixed to the upper half casing 41 in a state of being accommodated in the upper half casing 41. The lower half diaphragms 62 are fixed to the lower half casing 42 in a state of being accommodated in the lower half casing 42.

(Configuration of Bearing Portion)

The bearing portions 5 supports the rotor main body 21 such that the rotor main body 21 can rotate around the axis Ar. The bearing portions 5 are disposed inside the casing 4. The bearing portions 5 include a first bearing portion 51 and a second bearing portion 52.

On the first end 21*a* side in the axial direction Da, the first bearing portion 51 supports the rotor main body 21 with respect to the plurality of impellers 22. The first bearing portion 51 has a structure that is dividable in the vertical direction Dv. The first bearing portion 51 includes a journal bearing 53A. The journal bearing 53A receives loads in the radial directions Dr that act on the rotor main body 21.

On the second end 21*b* side in the axial direction Da, the second bearing portion 52 supports the rotor main body 21 with respect to the plurality of impellers 22. The second bearing portion 52 has a structure that is dividable in the vertical direction Dv. The second bearing portion 52 includes a journal bearing (bearing) 53B and a thrust bearing 54. The journal bearing 53B receives loads in the radial directions Dr that act on the rotor main body 21. The thrust bearing 54 receives a load in the axial direction Da that acts on the rotor main body 21. The thrust bearing 54 is disposed on the second end 21*b* side (side separated from central portion 21*c* of the rotor main body 21) in the axial direction Da with respect to the journal bearing 53B.

(Configuration of Seal Portion)

The seal portions 7 seal a gap between the rotor 2 and the casing 4. The seal portions 7 restrain a working fluid from flowing out to the outside of the casing 4 through the gap between the rotor 2 and the casing 4 and restrain foreign substances or the like from entering the casing 4 from the outside. The seal portions 7 are disposed at an interval in the axial direction Da with the plurality of impellers 22 interposed therebetween. The seal portions 7 include a first seal portion 7A on the first end 21*a* side and a second seal portion 7B on the second end 21*b* side. The first seal portion 7A is disposed at a position close to the central portion 21*c* of the rotor main body 21 in the axial direction Da with respect to the first bearing portion 51. The second seal portion 7B is disposed at a position close to the central portion 21*c* of the rotor main body 21 in the axial direction Da with respect to the second bearing portion 52.

Each of the first seal portion 7A and the second seal portion 7B includes a supporting ring 71 and a seal member 72. That is, the rotary machine 1 includes a pair of the supporting rings 71 and a pair of the seal members 72.

The supporting ring 71 extends in the circumferential direction Dc. A through-hole that is circular as seen in the axial direction Da is formed in a central portion of the supporting ring 71. That is, the supporting ring 71 has an annular shape. An outer peripheral surface of the supporting ring 71 abuts an inner peripheral surface of the upper half casing 41 and an inner peripheral surface of the lower half casing 42.

The seal member 72 is disposed inside the supporting ring 71 in the radial directions Dr. The seal member 72 is detachably fixed to an inner peripheral surface of the through-hole of the supporting ring 71. The seal member 72 is disposed between an inner peripheral surface of the supporting ring 71 and an outer peripheral surface of the rotor main body 21. The seal member 72 is fixed to the supporting ring 71 in a state where a clearance is formed between the seal member 72 and the outer peripheral surface of the rotor main body 21. In the present embodiment, the seal member 72 is a dry gas seal or a labyrinth seal, for example.

(Configuration of Supporting Jig)

Figure 2:
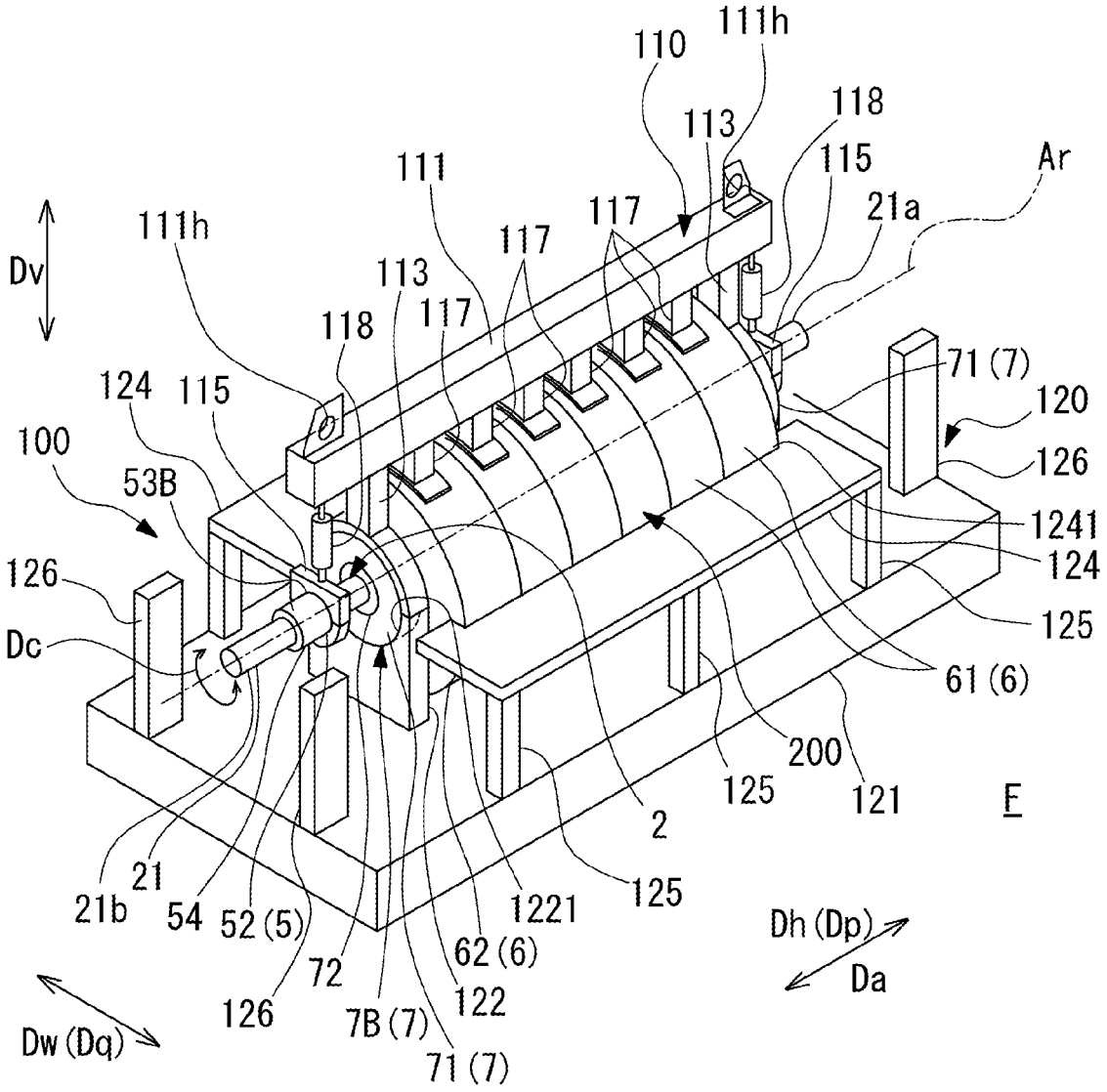
FIG. 2 is a perspective view showing a supporting jig according to the embodiment.
Figure 3:
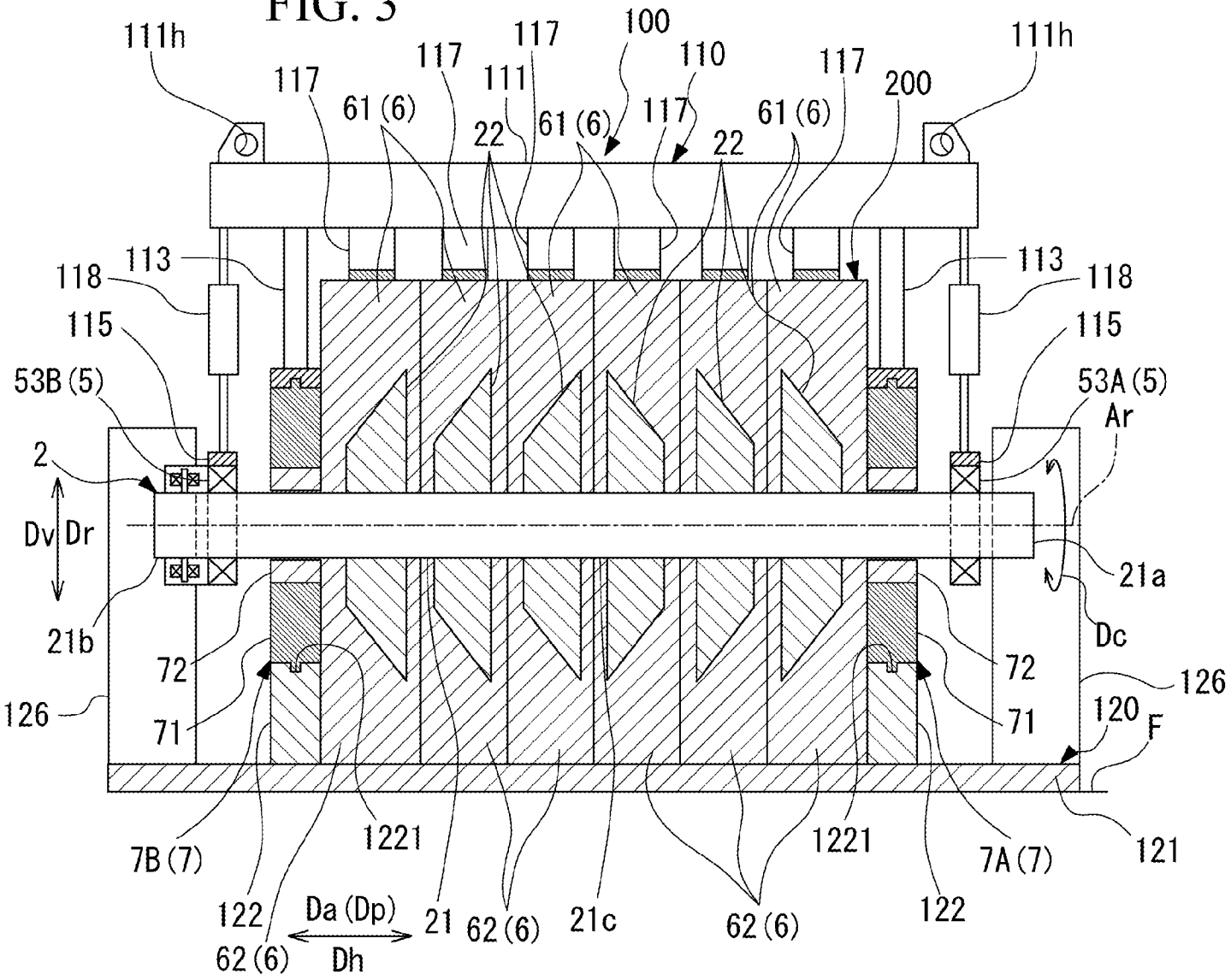
FIG. 3 is a sectional view showing a configuration of the supporting jig.

In the case of the rotary machine 1 as described above, at the time of disassembly or assembly for maintenance or the like, the rotor 2 (rotor main body 21 and plurality of impellers 22), the bearing portions 5, the seal portions 7, and the plurality of diaphragms 6 are integrally attached and detached with respect to the casing 4 by means of a suspending tool 110. Here, an aggregation of the rotor 2 (rotor main body 21 and plurality of impellers 22), the bearing portions 5, the seal portions 7, and the plurality of diaphragms 6 will be referred to as an internal unit 200. However, regarding the internal unit 200, the rotor 2, the bearing portions 5, the seal portions 7, and the plurality of diaphragms 6 are not fixed to each other to be integrated with each other. A supporting jig 100 described below is used for removal of the internal unit 200 from the casing 4 and attachment of the internal unit 200 to the casing 4. As shown in FIGS. 2 and 3, the supporting jig 100 includes the suspending tool 110 and a supporting base 120.

(Configuration of Suspending Tool)

The suspending tool 110 can hold the internal unit 200 in a suspended state. The suspending tool 110 includes a suspending tool main body 111, seal supporting portions 113, bearing supporting portions 115, diaphragm supporting portions 117, and vertical position adjusting portions 118.

The suspending tool main body 111 linearly extends along the horizontal direction Dh. At the time of use of the suspending tool 110, the suspending tool main body 111 is disposed extending in the axial direction Da so as to be parallel to the rotor main body 21 at a position above the rotor main body 21 in the vertical direction Dv. An attachment hole 111*h* is formed at each of both end portions of the suspending tool main body 111 in the axial direction Da. A wire or a hook of a lifting machine such as a crane can be attached to each attachment hole 111*h*. The suspending tool main body 111 can be moved in the vertical direction Dv by a lifting machine (not shown) of which a wire or a hook is attached to each attachment hole 111*h*.

The bearing supporting portions 115 are detachable from the first bearing portion 51 and the second bearing portion 52, which are the bearing portions 5. A pair of the bearing supporting portions 115 is disposed at the suspending tool main body 111 such that the bearing supporting portions 115 are disposed at an interval in the axial direction Da. The bearing supporting portions 115 are disposed at positions different from the positions of the seal supporting portions 113 in the axial direction Da. An upper end of each bearing supporting portion 115 is connected to the suspending tool main body 111. Each bearing supporting portion 115 extends downward in the vertical direction Dv from the suspending tool main body 111. Lower end portions of the bearing supporting portions 115 can be attached to and detached from the journal bearing 53A or the journal bearing 53B by means of a fixing member (not shown) such as a bolt. The bearing supporting portions 115 support the journal bearings 53A and 53B, so that the first end 21*a* side in the axial direction Da of the rotor main body 21 and the second end 21*b* in the axial direction Da are supported. That is, the bearing supporting portions 115 are fixed to the journal bearings 53A and 53B so as to support the rotor 2 supported by the journal bearings 53A and 53B.

The seal supporting portions 113 can support the first seal portion 7A and the second seal portion 7B, which are the seal portions 7. A pair of the seal supporting portions 113 is disposed at the suspending tool main body 111 such that the seal supporting portions 113 are disposed at an interval in the axial direction Da. The pair of seal supporting portions 113 is disposed inside the pair of bearing supporting portions 115 in the axial direction Da. The seal supporting portions 113 are disposed to overlap the first seal portion 7A and the second seal portion 7B as seen in the vertical direction Dv in a state where the bearing supporting portions 115 are fixed to the first bearing portion 51 and the second bearing portion 52. An upper end of each seal supporting portion 113 is connected to the suspending tool main body 111. Each seal supporting portion 113 extends downward in the vertical direction Dv from the suspending tool main body 111. In the present embodiment, lower end portions of the seal supporting portions 113 can be fixed to upper half portions of the supporting rings 71. The seal supporting portions 113 can be attached to and detached from the supporting rings 71 by means of a fixing member (not shown) such as a bolt.

The diaphragm supporting portions 117 can support the diaphragms 6. A plurality of the diaphragm supporting portions 117 are disposed at the suspending tool main body 111 such that the diaphragm supporting portions 117 are disposed at intervals in the axial direction Da. The number of the diaphragm supporting portions 117 is the same as the number of the diaphragms 6. The plurality of diaphragm supporting portions 117 are disposed inside the pair of seal supporting portions 113 in the axial direction Da. An upper end of each diaphragm supporting portion 117 is connected to the suspending tool main body 111. Each diaphragm supporting portion 117 extends downward in the vertical direction Dv from the suspending tool main body 111. In the present embodiment, lower end portions of the diaphragm supporting portions 117 are open to the lower side in the vertical direction Dv to be parallel with outer peripheral surfaces of the upper half diaphragms 61. The lower end portions of the diaphragm supporting portions 117 can be fixed to top portions of the upper half diaphragms 61. The diaphragm supporting portions 117 can be attached to and detached from the upper half diaphragms 61 by means of a fixing member (not shown) such as a bolt.

Figure 4:
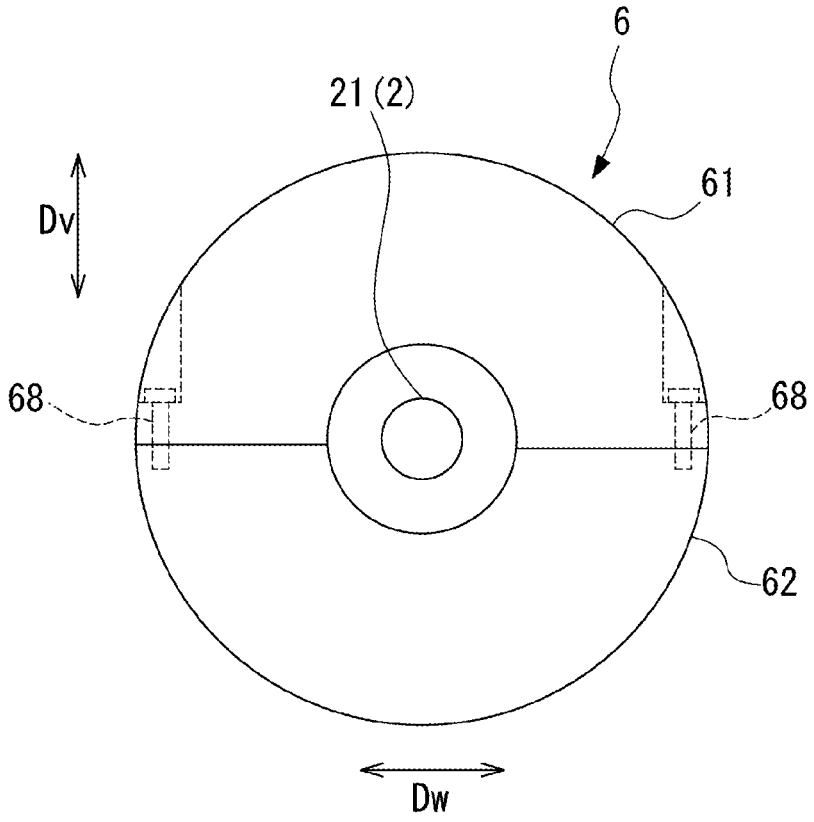
FIG. 4 is a view showing a configuration in which an upper half diaphragm and a lower half diaphragm are connected to each other.

Here, in a case where the upper half diaphragms 61 are supported by the diaphragm supporting portions 117, as shown in FIG. 4, the upper half diaphragms 61 and the lower half diaphragms 62 are detachably connected to each other by means of bolts serving as diaphragm connecting tools 68 on both sides in the width direction Dw. Accordingly, when the upper half diaphragms 61 are supported by the diaphragm supporting portions 117, the lower half diaphragms 62 are also supported. That is, the diaphragms 6 can be supported by the diaphragm supporting portions 117.

The vertical position adjusting portions 118 can adjust the positions of lower ends of the bearing supporting portions 115 in the vertical direction Dv with respect to the suspending tool main body 111. The vertical position adjusting portions 118 are disposed at intermediate portions of the bearing supporting portions 115. In the present embodiment, the vertical position adjusting portions 118 are, for example, turnbuckles.

(Configuration of Supporting Base)

As shown in FIGS. 2 and 3, the supporting base 120 can support the internal unit 200 and the suspending tool 110 supporting the internal unit 200. The supporting base 120 includes a base 121, unit supporting portions 122, diaphragm restricting members 124 (refer to FIG. 2), and grounding legs 126.

The base 121 has a rectangular shape as seen in the vertical direction Dv. The base 121 is placed on an installation surface F. The base 121 is disposed in a state where a longitudinal direction Dp thereof is parallel with the axial direction Da of the internal unit 200. The length of the base 121 in the longitudinal direction Dp is larger than the length of the internal unit 200 in the axial direction Da. It is preferable that the base 121 has such a size that the base 121 can be loaded onto a transport vehicle such as a truck or a trailer.

The unit supporting portions 122 support the suspending tool 110 supporting the internal unit 200, from below. A pair of the unit supporting portions 122 is disposed on the base 121. The pair of the unit supporting portions 122 is disposed such that the unit supporting portions 122 are disposed at an interval in the longitudinal direction Dp (axial direction Da) of the base 121. Each unit supporting portions 122 is disposed at a central portion in a lateral direction Dq (width direction Dw) of the base 121. Each unit supporting portion 122 extends upward in the vertical direction Dv from an upper surface of the base 121. Upper surfaces of the unit supporting portions 122 can support lower ends of the seal supporting portions 113 from below in the vertical direction Dv. The lower ends of the seal supporting portions 113 are detachably connected to the upper surfaces of the unit supporting portions 122 by means of bolts. In addition, in the unit supporting portions 122, groove portions 1221 into which lower half portions of the supporting rings 71 fixed to the seal supporting portions 113 can be accommodated are formed. The groove portions 1221 are formed in semi-arc shapes recessed downward while being formed along outer peripheral surfaces of the lower half portions of the supporting rings 71. That is, the lower half portions of the supporting rings 71 can be supported from below in the vertical direction Dv by being fitted into the groove portions 1221. In this manner, the lower ends of the seal supporting portions 113 and the lower half portions of the supporting rings 71 are supported by the two unit supporting portions 122 separated from each other in the axial direction Da, and thus the suspending tool 110 is supported by the pair of unit supporting portions 122. The internal unit 200 is supported by the suspending tool 110. That is, the internal unit 200 is supported by the unit supporting portions 122 via the suspending tool 110, on the supporting base 120.

Two sets of the diaphragm restricting members 124 are fixed onto the base 121. The two sets of the diaphragm restricting members 124 are disposed at an interval in the lateral direction Dq (width direction Dw) of the base 121. The diaphragm restricting members 124 are disposed to be positioned on both sides in the width direction Dw with respect to the internal unit 200, which is supported on the supporting base 120 via the suspending tool 110. The diaphragm restricting members 124 are fixed to a plurality of columns 125 which extend upward in the vertical direction Dv from the upper surface of the base 121. The plurality of columns 125 are fixed to the base 121 at intervals in the longitudinal direction Dp (axial direction Da) of the base 121. The diaphragm restricting members 124 include diaphragm accommodation groove portions 1241 on an inner side in the width direction Dw (side on which internal unit 200 is disposed). Each diaphragm accommodation groove portion 1241 is recessed outward in the width direction Dw (to side opposite to side on which internal unit 200 is disposed) and has such a size that end portions of the plurality of diaphragms 6 in the width direction Dw can be accommodated thereinto. Accordingly, the diaphragm restricting members 124 can restrict the movement of the diaphragms 6 in the axial direction Da.

Two sets of the grounding legs 126 are disposed such that a pair of the grounding legs 126 is disposed for each of both ends of the base 121 in the longitudinal direction Dp (axial direction Da). Each pair of the grounding legs 126 is disposed such that the grounding legs 126 are disposed at an interval in the lateral direction Dq (width direction Dw) of the base 121. Each grounding leg 126 extends upward in the vertical direction Dv to be orthogonal to a surface of the base 121. Each of the sets of the grounding legs 126 is formed such that an end portion of the base 121 in the longitudinal direction Dp (axial direction Da) and the grounding legs 126 are grounded to the installation surface F in a case where the supporting base 120 and the internal unit 200 are erected such that the axial direction Da is parallel with the vertical direction Dv.

(Procedure for Rotary Machine Disassembling Method)

Figure 5:
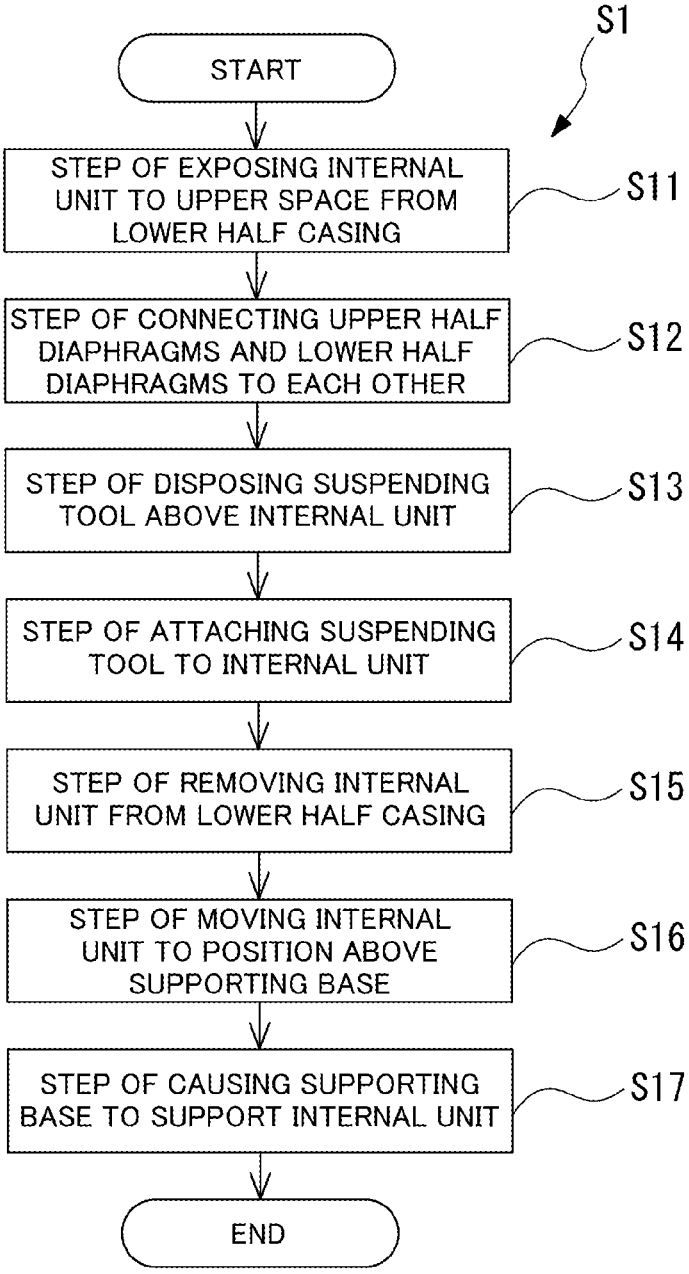
FIG. 5 is a flowchart showing the procedure of a disassembling method for a rotary machine according to the embodiment.

Next, a disassembling method for the rotary machine 1 will be described. As shown in FIG. 5, a disassembling method S1 for a rotary machine includes a step S11 of exposing the internal unit 200 to an upper space from the lower half casing 42, a step S12 of connecting the upper half diaphragms 61 and the lower half diaphragms 62 to each other, a step S13 of disposing the suspending tool 110 above the internal unit 200, a step S14 of attaching the suspending tool 110 to the internal unit 200, a step S15 of removing the internal unit 200 from the lower half casing 42, a step S16 of moving the internal unit 200 to a position above the supporting base 120, and a step S17 of causing the supporting base 120 to support the internal unit 200.

Figure 6:
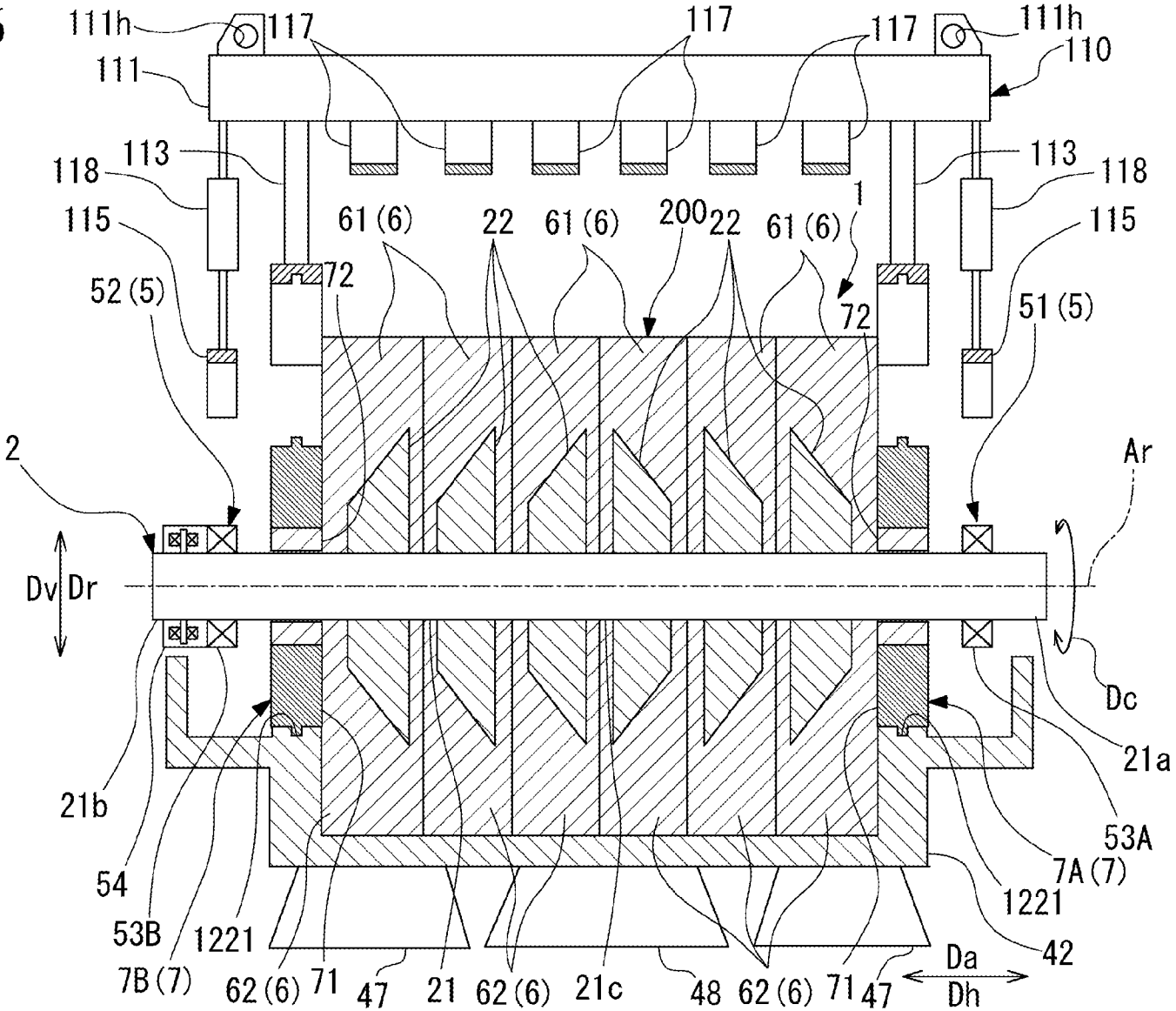
FIG. 6 is a view showing a step of exposing an internal unit to an upper space from a lower half casing, a step of disposing a suspending tool above the internal unit, and a step of removing the suspending tool from the internal unit.

In the step S11 of exposing the internal unit 200 to the upper space from the lower half casing 42, as shown in FIG. 6, the upper half casing 41 of the casing 4 of the rotary machine 1 is removed from the lower half casing 42 after the suspending tool 110 is prepared. In this manner, the upper half of the internal unit 200 is exposed to the upper space from the lower half casing 42.

In the step S12 of connecting the upper half diaphragms 61 and the lower half diaphragms 62 to each other, as shown in FIG. 4, the upper half diaphragms 61 and the lower half diaphragms 62 are connected to each other by means of bolts serving as the diaphragm connecting tools 68 on both sides in the width direction Dw.

In the step S13 of disposing the suspending tool 110 above the internal unit 200, first, wires or hooks of a lifting machine such as a crane are attached to the attachment holes 111*h* of the suspending tool main body 111 shown in FIG. 6. Next, the suspending tool main body 111 is lifted up by means of the lifting machine and the suspending tool 110 is disposed above the internal unit 200. The suspending tool 110 is disposed above the internal unit 200 such that a direction in which the suspending tool main body 111 extends is parallel with the axial direction Da.

Figure 7:
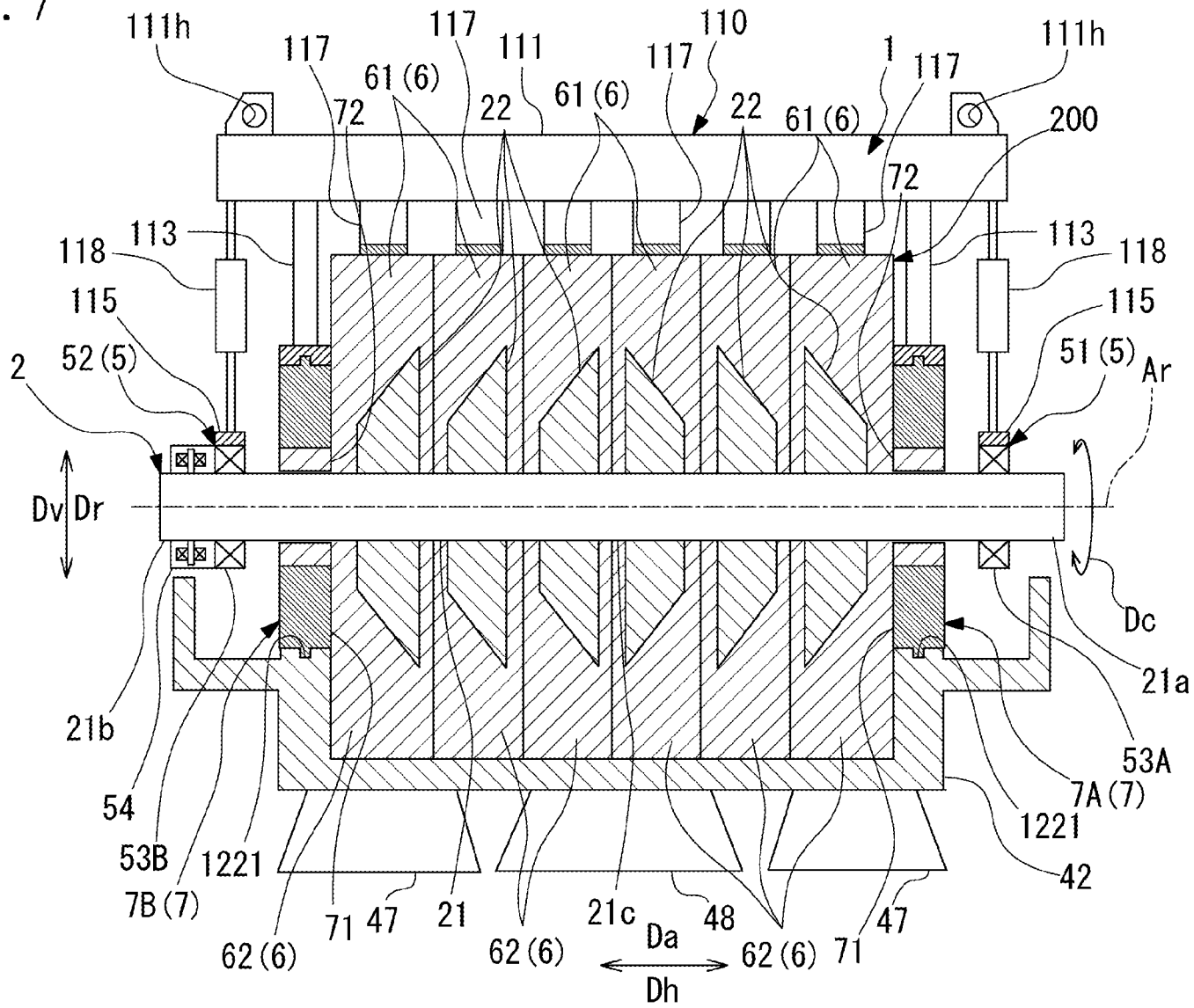
FIG. 7 is a view showing a step of attaching the suspending tool to the internal unit.

In the step S14 of attaching the suspending tool 110 to the internal unit 200, first, the suspending tool main body 111 lifted up is lowered by means of the lifting machine after the suspending tool 110 is disposed above the internal unit 200. Accordingly, as shown in FIG. 7, lower ends of the pair of bearing supporting portions 115 of the suspending tool 110 are disposed along upper half portions of the journal bearings 53A and 53B. Thereafter, the lower ends of the bearing supporting portions 115 are connected to the upper half portions of the journal bearings 53A and 53B by means of fastening members such as bolts. Similarly, lower ends of the pair of seal supporting portions 113 are disposed along upper half portions of the pair of supporting rings 71. Thereafter, the lower ends of the seal supporting portions 113 are connected to the upper half portions of the supporting rings 71 by means of fastening members such as bolts. In addition, lower ends of the plurality of diaphragm supporting portions 117 are disposed along upper half portions of the upper half diaphragms 61. Thereafter, the lower ends of the diaphragm supporting portions 117 are connected to the upper half portions of the upper half diaphragms 61 by means of fastening members such as bolts. Accordingly, the internal unit 200 is fixed to the suspending tool 110 in a state of being immovable.

Figure 8:
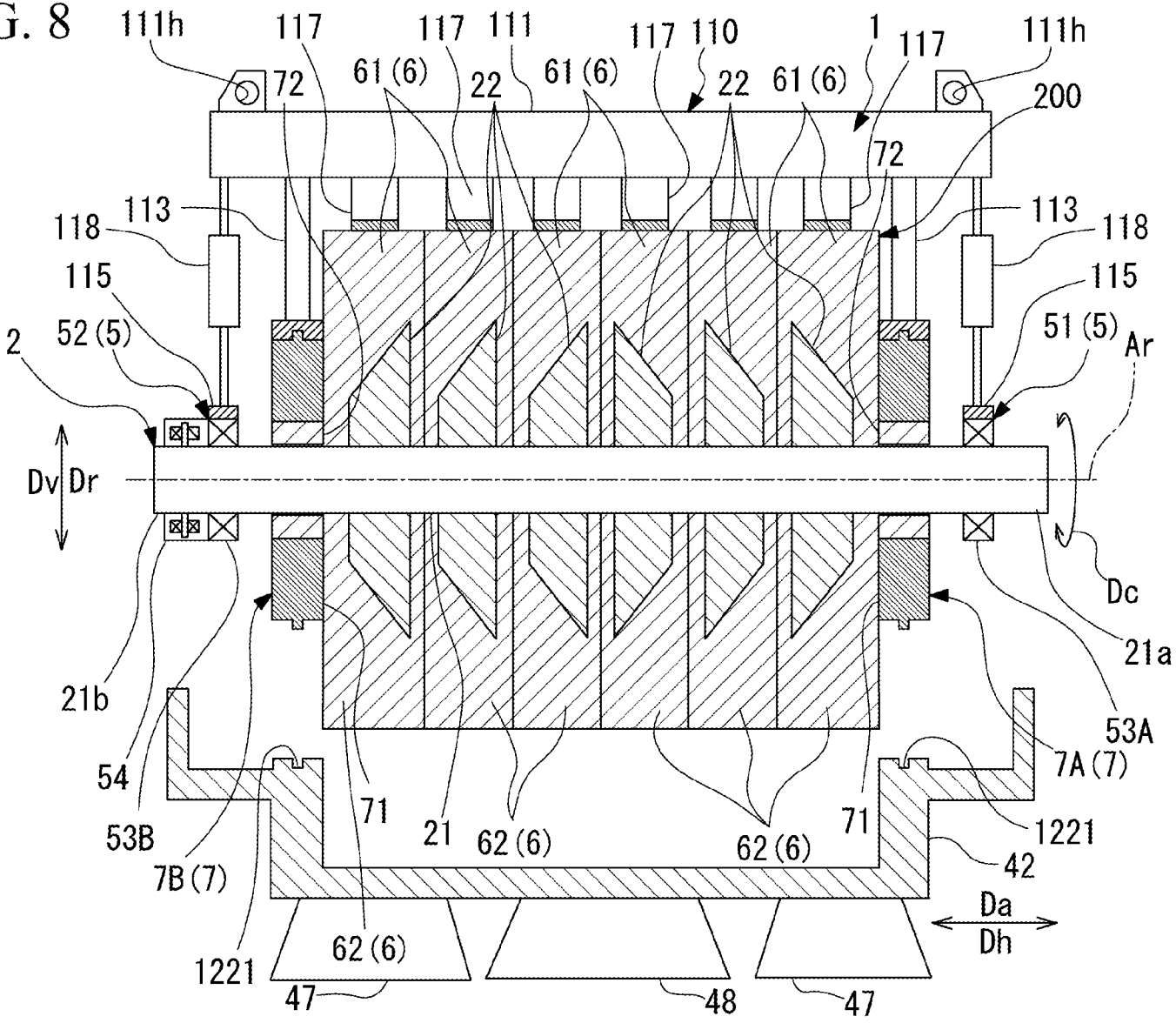
FIG. 8 is a view showing a step of removing the internal unit from the lower half casing and a step of disposing the internal unit above the lower half casing.

In the step S15 of removing the internal unit 200 from the lower half casing 42, the suspending tool main body 111 is lifted up and raised by means of the lifting machine. Accordingly, as shown in FIG. 8, the internal unit 200 suspended from the suspending tool 110 is removed from the lower half casing 42. In this state, each of the rotor 2 (rotor main body 21 and plurality of impellers 22), the journal bearings 53A and 53B, the seal portions 7, and the diaphragms 6 is individually supported by the suspending tool 110.

Figure 9:
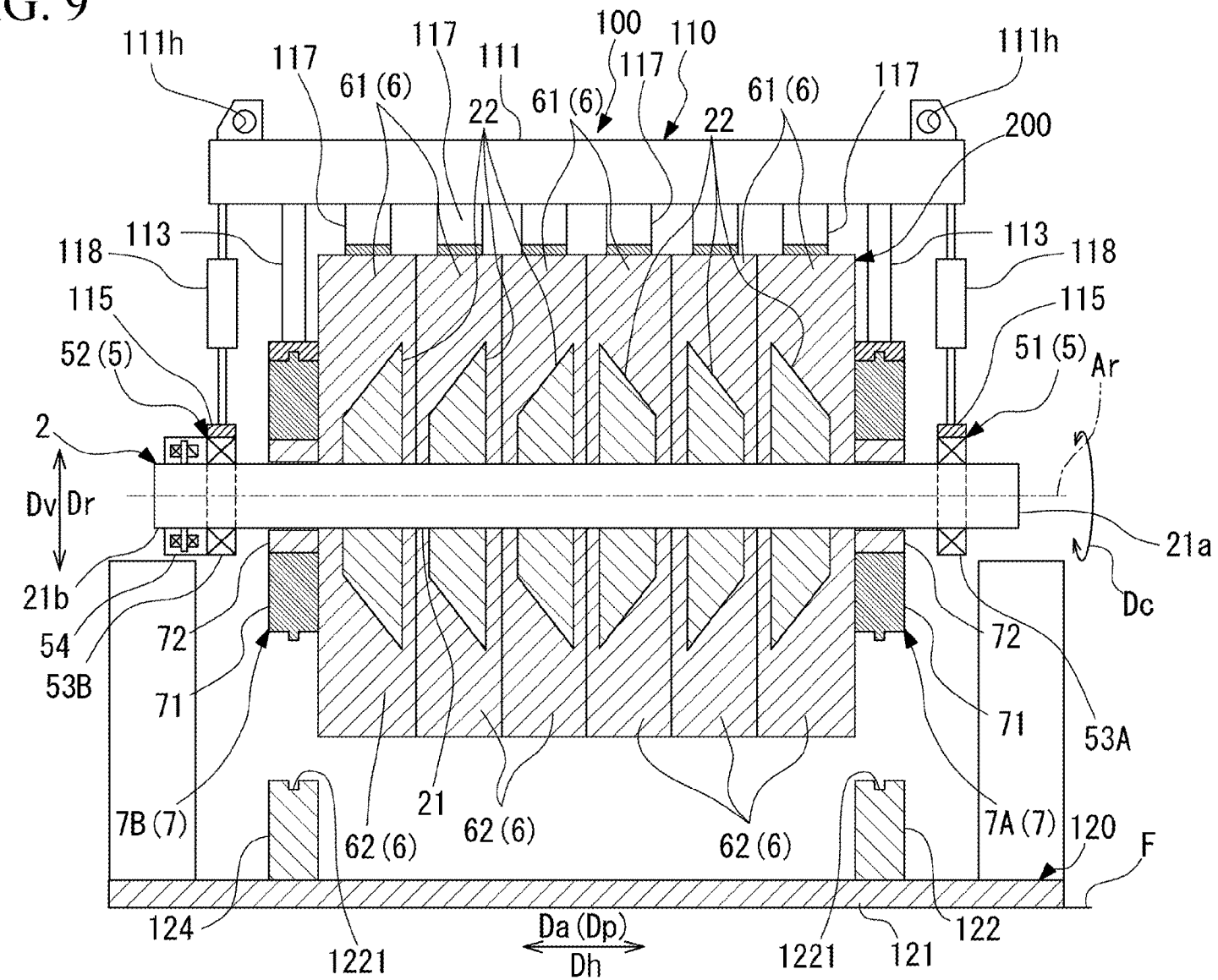
FIG. 9 is a view showing a step of moving the internal unit to a position above a supporting base.

In the step S16 of moving the internal unit 200 to the position above the supporting base 120, by means of the lifting machine, the internal unit 200 suspended from the suspending tool 110 is moved to the position above the supporting base 120 which is disposed outside the rotary machine 1 in advance, as shown in FIG. 9.

In the step S17 of causing the supporting base 120 to support the internal unit 200, the suspending tool main body 111 is lowered by means of the lifting machine. As shown in FIG. 3, when the suspending tool main body 111 is lowered, the lower ends of the seal supporting portions 113 are placed on the upper surfaces of the unit supporting portions 122 in a state where the lower half portions of the supporting rings 71 are accommodated in the groove portions 1221. Accordingly, both end portions in the width direction Dw of each of the plurality of diaphragms 6 are accommodated in the diaphragm accommodation groove portions 1241 of the two sets of diaphragm restricting members 124. That is, the plurality of diaphragms 6 enter a state where the movement thereof in the axial direction Da is restricted. Thereafter, the lower ends of the seal supporting portions 113 and the unit supporting portions 122 are connected to each other by means of bolts or the like (not shown). Accordingly, the suspending tool 110 is supported by the pair of unit supporting portions 122. As a result, the internal unit 200 is fixed to the suspending tool 110 together with the suspending tool 110 in a state of being immovable.

After the internal unit 200 is made immovable, the internal unit 200 and the suspending tool 110 can be loaded together with the supporting base 120 to a transportation vehicle and be transported to a factory or the like that is different from a place where the rotary machine 1 is installed. In addition, the supporting base 120 and the internal unit 200 can be stored in a state of being erected such that the axial direction Da is parallel with the vertical direction. At this time, an end portion of the base 121 in the longitudinal direction Dp (axial direction Da) and the grounding legs 126 are grounded to the installation surface F.

Thereafter, each member constituting the internal unit 200 is removed from the suspending tool 110 so that the internal unit 200 is disassembled and a necessary maintenance operation is performed.

(Procedure for Rotary Machine Assembling Method)

Next, an assembling method S2 for the rotary machine 1 will be described.

Figure 10:
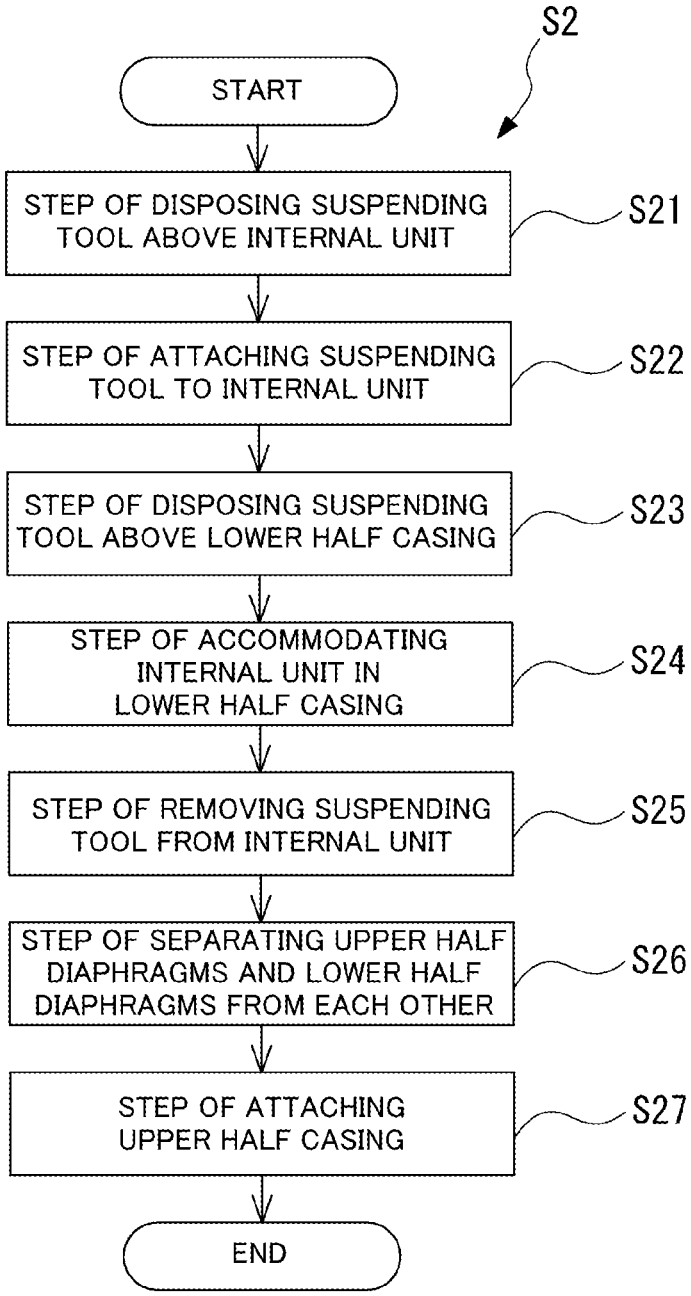
FIG. 10 is a flowchart showing the procedure of an assembling method for the rotary machine according to the embodiment.

As shown in FIG. 10, an assembling method S2 for the rotary machine 1 includes a step S21 of disposing the suspending tool 110 above the internal unit 200, a step S22 of attaching the suspending tool 110 to the internal unit 200, a step S23 of disposing the suspending tool 110 above the lower half casing 42, a step S24 of accommodating the internal unit 200 in the lower half casing 42, a step S25 of removing the suspending tool 110 from the internal unit 200, a step S26 of separating the upper half diaphragms 61 and the lower half diaphragms 62 from each other, and a step S27 of attaching the upper half casing 41.

In the step S21 of disposing the suspending tool 110 above the internal unit 200, the suspending tool 110 is disposed above the internal unit 200 supported by the supporting base 120. At this time, the upper half diaphragms 61 and the lower half diaphragms 62 are connected to each other in advance by means of the diaphragm connecting tools 68.

In the step S22 of attaching the suspending tool 110 to the internal unit 200, the suspending tool main body 111 lifted up is lowered by means of the lifting machine after the suspending tool 110 is disposed above the internal unit 200. Then, similarly to the step S14 of attaching the suspending tool 110 to the internal unit 200, the lower ends of the pair of bearing supporting portions 115 are connected to the upper half portions of the journal bearings 53A and 53B by means of fastening members such as bolts. In addition, the lower ends of the pair of seal supporting portions 113 are connected to the upper half portions of the pair of supporting rings 71 by means of fastening members such as bolts. In addition, the lower ends of the plurality of diaphragm supporting portions 117 are respectively connected to the upper half portions of the upper half diaphragms 61 by means of fastening members such as bolts.

In the step S23 of disposing the suspending tool 110 above the lower half casing 42, as shown in FIG. 9, the suspending tool main body 111 is lifted up by the lifting machine and the internal unit 200 is raised together with the suspending tool 110 from the supporting base 120. Accordingly, the internal unit 200 is removed from the supporting base 120. Furthermore, the position of the suspending tool main body 111 lifted up is moved by means of the lifting machine. Accordingly, as shown in FIG. 8, the internal unit 200 suspended from the suspending tool 110 is moved to a position above the lower half casing 42.

In the step S24 of accommodating the internal unit 200 in the lower half casing 42, the suspending tool 110 is lowered by means of the lifting machine. Accordingly, as shown in FIG. 7, the internal unit 200 suspended from the suspending tool 110 is accommodated in the lower half casing 42.

In the step S25 of removing the suspending tool 110 from the internal unit 200, as shown in FIG. 6, the seal supporting portions 113 are separated from the supporting rings 71. In addition, the diaphragm supporting portions 117 are separated from the upper half diaphragms 61. Furthermore, the bearing supporting portions 115 are separated from the journal bearings 53A and 53B. Accordingly, the suspending tool 110 is separated from the internal unit 200. Thereafter, the suspending tool 110 is lifted up by the lifting machine and is moved from a position above the internal unit 200.

In the step S26 of separating the upper half diaphragms 61 and the lower half diaphragms 62 from each other, as shown in FIG. 4, the bolts as the diaphragm connecting tools 68 connecting the upper half diaphragms 61 and the lower half diaphragms 62 to each other are removed. Accordingly, the upper half diaphragms 61 and the lower half diaphragms 62 are separated from each other, so that the upper half diaphragms 61 become movable with respect to the lower half diaphragms 62.

In the step S27 of attaching the upper half casing 41, as shown in FIG. 1, the upper half casing 41 is placed on the lower half casing 42 from a position above the internal unit 200 and the casing 4 is assembled. Accordingly, the rotary machine 1 with the internal unit 200 incorporated thereinto is assembled.

(Effect)

In the case of the suspending tool 110 configured as described above, the pair of journal bearings 53A and 53B is supported by the bearing supporting portions 115, so that the rotor main body 21 and the plurality of impellers 22 are supported via the journal bearings 53A and 53B. The supporting rings 71 are supported by the seal supporting portions 113. The diaphragms 6 are respectively supported by the diaphragm supporting portions 117. As a result, the suspending tool 110 can integrally lift up the internal unit 200 not mutually fixed. Accordingly, each of the rotor main body 21, the plurality of impellers 22, the seal portions 7, and the diaphragms 6 is individually supported by the suspending tool 110. Furthermore, the rotor main body 21, the plurality of impellers 22, the seal portions 7, and the diaphragms 6 are supported in a state where the positions thereof cannot be moved with respect to each other. Therefore, it is possible to suppress damage to members or the like caused by a load mutually acting among the rotor main body 21, the plurality of impellers 22, the seal portions 7, and the diaphragms 6 which are not fixed to each other. As a result, it is possible to improve the efficiency of a maintenance operation even with respect to the rotary machine 1 including components that cannot be fixed to each other.

In addition, the positions of the bearing supporting portions 115 in the vertical direction Dv with respect to the suspending tool main body 111 can be adjusted by means of the vertical position adjusting portions 118. Therefore, it is possible to adjust the positions of the bearing supporting portions 115 in the vertical direction Dv when the pair of journal bearings 53A and 53B is to be supported by the bearing supporting portions 115. Therefore, the suspending tool 110 can support the journal bearings 53A and 53B without shifting the positions thereof. Therefore, the rotor 2 can be supported in a state where the position of the axis Ar of the rotor main body 21 is aligned.

In addition, the supporting jig 100 configured as described above includes the supporting base 120 that supports the internal unit 200 suspended from the suspending tool 110 from below. The supporting base 120 can support the seal supporting portions 113 from below at the unit supporting portions 122. Accordingly, the internal unit 200 lifted up by the suspending tool 110 can be supported by the unit supporting portions 122. Furthermore, it is possible to stably fix the internal unit 200 and the suspending tool 110 to the supporting base 120 by connecting the seal supporting portions 113 to the unit supporting portions 122.

In addition, the supporting base 120 includes the diaphragm restricting members 124. The diaphragm restricting members 124 suppress the movement of the internal unit 200 supported by the supporting base 120, in the axial direction Da.

In addition, the supporting base 120 includes the grounding legs 126 extending to be orthogonal to the surface of the base 121. With the grounding legs 126 grounded to the installation surface, the supporting base 120 and the internal unit 200 can be erected such that the axial direction Da coincides with the vertical direction Dv. That is, the internal unit 200 supported by the supporting base 120 can be stored in an erected state. Therefore, it is possible to reduce a space required for storage of the internal unit 200. In addition, since the grounding legs 126 are disposed at the base 121, the supporting base 120 and the internal unit 200 can be maintained in a posture of being stably erected.

In addition, according to the disassembling method S1 or the assembling method S2 for the rotary machine 1 as described above, the rotor main body 21, the plurality of impellers 22, the seal portions 7, and the diaphragms 6 are supported by the suspending tool 110 in a state where the positions thereof cannot be moved with respect to each other. Therefore, it is not necessary to disassemble or assemble the diaphragms 6 separately from the rotor 2. As a result, it is possible to reduce labor required for a disassembling operation or an assembling operation for the rotary machine 1 and to improve the efficiency of a maintenance operation and the operation rate of the rotary machine 1.

In addition, the upper half diaphragms 61 and the lower half diaphragms 62 are connected to each other by means of the diaphragm connecting tools 68. Accordingly, it is possible to integrally lift up the upper half diaphragms 61 and the lower half diaphragms 62 by using the suspending tool 110 only by fixing the suspending tool 110 to the upper half diaphragms 61.

In addition, after the internal unit 200 is mounted onto the lower half casing 42 from above, the diaphragm connecting tools 68 are removed and the upper half diaphragms 61 and the lower half diaphragms 62 are separated from each other. Accordingly, it is possible to allow the upper half diaphragms 61 to be displaced with respect to the lower half diaphragms 62 together with the upper half casing 41 when the upper half casing 41 is attached onto the lower half casing 42. Accordingly, it is possible to easily mount the upper half casing 41. In addition, it is possible to suppress damage to the diaphragm connecting tools 68 caused when the upper half casing 41 is mounted.

Modification Example of Embodiment

Note that, in the above-described embodiment, a centrifugal compressor has been described as an example of the rotary machine 1. However, the rotary machine 1 is not limited to a compressor. The rotary machine 1 may be, for example, a steam turbine or the like.

In addition, in the above-described embodiment, the procedures of the disassembling method S1 for the rotary machine 1 and the assembling method S2 for the rotary machine 1 have been described. However, the contents of detailed operations in each step can be appropriately changed.

APPENDIX

The suspending tool 110, the supporting jig 100, the disassembling method S1 for the rotary machine 1, and the assembling method S2 for the rotary machine 1 described in the embodiment are understood as follow, for example.

(1) The suspending tool 110 according to a first aspect is the suspending tool 110 from which the internal unit 200 of the rotary machine 1 is configured to suspend, the internal unit 200 including the rotor main body 21 that extends in the axial direction Da, the plurality of impellers 22 that are disposed at intervals in the axial direction Da and are fixed to the outer side of the rotor main body 21 in the radial direction Dr, the pair of supporting rings 71 that are disposed at the first end 21*a* and the second end 21*b* of the rotor main body 21 at an interval in the axial direction Da, are disposed outside the rotor main body 21 in the radial direction Dr, and have an annular shape, the pair of bearing portions 5 that are disposed outside the pair of supporting rings 71 in the axial direction Da, and the plurality of diaphragms 6 that are disposed to be arranged in the axial direction Da and respectively cover the plurality of impellers 22 from an outer side in the radial direction Dr. The suspending tool 110 includes the suspending tool main body 111 that is configured to extend to be parallel with the axial direction Da above the rotor main body 21, the pair of bearing supporting portions 115 that are disposed at an interval in the axial direction Da, are connected to the suspending tool main body 111, and are detachable from the bearing portions 5, the pair of seal supporting portions 113 that are disposed inside the pair of bearing supporting portions 115 in the axial direction Da at an interval in the axial direction Da, are connected to the suspending tool main body 111, and are detachable from the supporting rings 71, and the plurality of diaphragm supporting portions 117 that are disposed inside the pair of seal supporting portions 113 in the axial direction Da such that the diaphragm supporting portions 117 are disposed at intervals in the axial direction Da, are connected to the suspending tool main body 111, and are detachable from the diaphragms 6.

Examples of the rotary machine 1 include a centrifugal compressor, a steam turbine, or the like.

In the suspending tool 110, the bearing portions 5 are supported by the bearing supporting portions 115 and thus the rotor main body 21 and the plurality of impellers 22 are supported via the bearing portions 5. The supporting rings 71 are supported by the seal supporting portions 113. The diaphragms 6 are respectively supported by the diaphragm supporting portions 117. As a result, the suspending tool 110 can integrally lift up the internal unit 200 not mutually fixed. Accordingly, each of the rotor main body 21, the plurality of impellers 22, the supporting rings 71, and the diaphragms 6 is individually supported by the suspending tool 110. Furthermore, the rotor main body 21, the plurality of impellers 22, the supporting rings 71, and the diaphragms 6 are supported in a state where the positions thereof cannot be moved with respect to each other. Therefore, it is possible to suppress damage to members or the like caused by a load mutually acting among the rotor main body 21, the plurality of impellers 22, the supporting rings 71, and the diaphragms 6 which are not fixed to each other. As a result, it is possible to improve the efficiency of a maintenance operation even with respect to the rotary machine 1 including components that cannot be fixed to each other.

(2) The suspending tool 110 according to a second aspect may be the suspending tool 110 of (1) that further includes the vertical position adjusting portions 118 that are configured to adjust the positions of the bearing supporting portions 115 in the vertical direction Dv with respect to the suspending tool main body 111.

Examples of the diaphragm connecting tools 68 include bolts or the like.

Accordingly, it is possible to adjust the positions of the bearing supporting portions 115 in the vertical direction Dv when the pair of bearing portions is to be supported by the bearing supporting portions 115. Therefore, the suspending tool 110 can support the bearing portions without shifting the positions thereof. Therefore, the rotor 2 can be supported in a state where the position of the axis Ar of the rotor main body 21 is aligned.

(3) The supporting jig 100 according to a third aspect includes the suspending tool 110 of (1) or (2) and the supporting base 120 that is configured to support the internal unit 200 suspended from the suspending tool 110 from below. The supporting base 120 includes the base 121 and the unit supporting portions 122 that are fixed to the base 121 and are configured to support the seal supporting portions 113 from below and to which the seal supporting portions 113 are detachably connected.

Accordingly, the internal unit 200 lifted up by the suspending tool 110 can be supported by the unit supporting portions 122. Furthermore, it is possible to stably fix the internal unit 200 and the suspending tool 110 to the supporting base 120 by connecting the seal supporting portions 113 to the unit supporting portions 122.

(4) The supporting jig 100 according to a fourth aspect may be the supporting jig 100 of (3) in which the supporting base 120 further includes diaphragm restricting members 124 that are fixed to the base 121 and are configured to restrict the movement of the plurality of diaphragms 6 in the axial direction Da.

The diaphragm restricting members 124 suppress the movement of the internal unit 200 supported by the supporting base 120, in the axial direction Da.

(5) The supporting jig 100 according to a fifth aspect may be the supporting jig 100 of (3) or (4) in which the supporting base 120 includes the grounding legs 126 that are configured to extend toward the rotor main body 21 from an end portion of the base 121 in the axial direction Da to be orthogonal to a surface of the base 121.

With the grounding legs 126 grounded to the installation surface, the supporting base 120 and the internal unit 200 can be erected such that the axial direction Da coincides with the vertical direction Dv. That is, the internal unit 200 supported by the supporting base 120 can be stored in an erected state. Therefore, it is possible to reduce a space required for storage of the internal unit 200. In addition, since the grounding legs 126 are disposed at the base 121, the supporting base 120 and the internal unit 200 can be maintained in a posture of being stably erected.

(6) The disassembling method S1 for the rotary machine 1 according to a sixth aspect is the disassembling method S1 for the rotary machine in which the rotary machine 1, which includes the casing 4 including the lower half casing 42 and the upper half casing 41 disposed above the lower half casing 42 and in which the internal unit 200 is disposed inside the casing 4, is disassembled by using the suspending tool described in (1) or (2), the disassembling method S1 including the step S11 of exposing an upper half portion of the internal unit 200 on the lower half casing 42 by removing the upper half casing 41, the step S13 of disposing the suspending tool 110 above the internal unit 200 of which the upper half portion is exposed, the step S14 of attaching the suspending tool 110 to the internal unit 200 by fixing the pair of bearing supporting portions 115 to the pair of bearing portions 5 respectively, fixing the pair of seal supporting portions 113 to the pair of supporting rings 71 respectively, and fixing the plurality of diaphragm supporting portions 117 to the plurality of diaphragms 6 respectively after the suspending tool 110 is disposed above the internal unit 200, and the step S15 of removing the internal unit 200 from the lower half casing 42 by lifting up the suspending tool 110 attached to the internal unit 200.

By means of the suspending tool 110, the rotor main body 21, the plurality of impellers 22, the supporting rings 71, and the diaphragms 6 are supported in a state where the positions thereof cannot be moved with respect to each other. Therefore, it is not necessary to disassemble the diaphragms 6 separately from the rotor 2. As a result, it is possible to reduce labor required for a disassembling operation for the rotary machine 1 and to improve the efficiency of a maintenance operation and the operation rate of the rotary machine 1.

(7) The disassembling method S1 for the rotary machine 1 according to a seventh aspect is the disassembling method S1 for the rotary machine 1 of (6) in which the plurality of diaphragms 6 are dividable into the upper half diaphragms 61 and the lower half diaphragms 62 and the disassembling method further includes the step S12 of connecting the upper half diaphragms 61 and the lower half diaphragms 62 to each other by means of the diaphragm connecting tools 68 after the upper half portion of the internal unit 200 is exposed.

Accordingly, it is possible to integrally lift up the upper half diaphragms 61 and the lower half diaphragms 62 by using the suspending tool 110 only by fixing the suspending tool 110 to the upper half diaphragms 61.

(8) The assembling method S2 for the rotary machine 1 according to an eighth aspect is the assembling method S2 for the rotary machine 1 in which the rotary machine 1, which includes the casing 4 including the lower half casing 42 and the upper half casing 41 disposed above the lower half casing 42 and in which the internal unit 200 is disposed inside the casing 4, is assembled by using the suspending tool 110 described in (1) or (2), the assembling method including the step S21 of disposing the suspending tool 110 above the internal unit 200, the step S22 of attaching the suspending tool 110 to the internal unit 200 by fixing the pair of bearing supporting portions 115 to the pair of bearing portions 5 respectively, fixing the pair of seal supporting portions 113 to the pair of supporting rings 71 respectively, and fixing the plurality of diaphragm supporting portions 117 to the plurality of diaphragms 6 respectively after the suspending tool 110 is disposed above the internal unit 200, the step S24 of lifting up the suspending tool 110 attached to the internal unit 200 and accommodating the internal unit 200 in the lower half casing 42, and the step S27 of attaching the upper half casing 41 onto the lower half casing 42.

By means of the suspending tool 110, the rotor main body 21, the plurality of impellers 22, the supporting rings 71, and the diaphragms 6 are supported in a state where the positions thereof cannot be moved with respect to each other. Therefore, it is not necessary to assemble the diaphragms 6 separately from the rotor 2. As a result, it is possible to reduce labor required for an assembling operation for the rotary machine 1 and to improve the efficiency of a maintenance operation and the operation rate of the rotary machine 1.

(9) The assembling method S2 for the rotary machine 1 according to a ninth aspect may be the assembling method S2 for the rotary machine 1 of (8) in which the plurality of diaphragms 6 are dividable into the upper half diaphragms 61 and the lower half diaphragms 62, the upper half diaphragms 61 and the lower half diaphragms 62 are connected to each other by means of the diaphragm connecting tools 68 before the plurality of diaphragm supporting portions 117 are fixed to the plurality of diaphragms 6 respectively in the step S22 of attaching the suspending tool 110 to the internal unit 200, and the assembling method S2 further includes the step S26 of separating the upper half diaphragms 61 and the lower half diaphragms 62 from each other by removing the diaphragm connecting tools 68 after the step S24 of accommodating the internal unit 200 in the lower half casing 42.

Accordingly, after the internal unit 200 is mounted onto the lower half casing 42 from above, the diaphragm connecting tools 68 are removed and the upper half diaphragms 61 and the lower half diaphragms 62 are separated from each other. Accordingly, it is possible to allow the upper half diaphragms 61 to be displaced with respect to the lower half diaphragms 62 together with the upper half casing 41 when the upper half casing 41 is attached onto the lower half casing 42. Accordingly, it is possible to easily mount the upper half casing 41. In addition, it is possible to suppress damage to the diaphragm connecting tools 68 caused when the upper half casing 41 is mounted.

INDUSTRIAL APPLICABILITY

With a suspending tool, a supporting jig, a disassembling method for a rotary machine, and an assembling method for a rotary machine according to the present disclosure, it is possible to improve the efficiency of a maintenance operation with respect to a rotary machine including internal components that cannot be fixed to each other.

EXPLANATION OF REFERENCES

1: rotary machine
2: rotor
4: casing
5: bearing portion
6: diaphragm
7: seal portion
7A: first seal portion
7B: second seal portion
21: rotor main body
21*a*: first end
21*b*: second end
21*c*: central portion
22: impeller
41: upper half casing
42: lower half casing
47: suction port
48: discharge port
51: first bearing portion
52: second bearing portion
53A, 53B: journal bearing
54: thrust bearing
61: upper half diaphragm
62: lower half diaphragm
68: diaphragm connecting tool
71: supporting ring
72: seal member
100: supporting jig
110: suspending tool
111: suspending tool main body
111*h*: attachment hole
113: seal supporting portion
115: bearing supporting portion
117: diaphragm supporting portion
118: vertical position adjusting portion
120: supporting base
121: base
122: unit supporting portion
1221: groove portion
124: diaphragm restricting member
1241: diaphragm accommodation groove portion
125: column
126: grounding leg
200: internal unit
Ar: axis
Da: axial direction
Dc: circumferential direction
Dh: horizontal direction
Dp: longitudinal direction
Dq: lateral direction
Dr: radial direction
Dv: vertical direction
Dw: width direction
F: installation surface
S1: disassembling method
S11: step of exposing internal unit to upper space from lower half casing
S12: step of connecting upper half diaphragms and lower half diaphragms to each other
S13: step of disposing suspending tool above internal unit
S14: step of attaching suspending tool to internal unit
S15: step of removing internal unit from lower half casing
S16: step of moving internal unit to position above supporting base
S17: step of causing supporting base to support internal unit
S2: assembling method
S21: step of disposing suspending tool above internal unit
S22: step of attaching suspending tool to internal unit
S23: step of disposing suspending tool above lower half casing
S24: step of accommodating internal unit in lower half casing
S25: step of removing suspending tool from internal unit
S26: step of separating upper half diaphragms and lower half diaphragms from each other
S27: step of attaching upper half casing

What is claimed is:

1. A suspending tool from which an internal unit of a rotary machine is configured to suspend, the internal unit including a rotor main body that extends in an axial direction, a plurality of impellers that are disposed at intervals in the axial direction and are fixed to an outer side of the rotor main body in a radial direction, a pair of seal portions that are disposed at a first end and a second end of the rotor main body at an interval in the axial direction, are disposed outside the rotor main body in the radial direction, and have an annular shape, a pair of bearing portions that are disposed outside the pair of seal portions in the axial direction, and a plurality of diaphragms that are disposed to be arranged in the axial direction and respectively cover the plurality of impellers from an outer side in the radial direction and the suspending tool comprising:

a suspending tool main body that is configured to extend to be parallel with the axial direction above the rotor main body;

a pair of bearing supporting portions that are disposed at an interval in the axial direction, are connected to the suspending tool main body, and are detachable from the bearing portions;

a pair of seal supporting portions that are disposed inside the pair of bearing supporting portions in the axial direction at an interval in the axial direction, are connected to the suspending tool main body, and are detachable from the seal portions; and a plurality of diaphragm supporting portions that are disposed inside the pair of seal supporting portions in the axial direction at intervals in the axial direction, are connected to the suspending tool main body, and are detachable from the diaphragms, wherein each of the pair of bearing supporting portions, the pair of seal supporting portions, and the plurality of diaphragm supporting portions extends downward in a vertical direction from the suspending tool main body, and is fixed to the suspending tool main body in a non-detachable state, and wherein the suspending tool is configured to suspend the rotor, the pair of bearing portions, the pair of seal portions, and the plurality of diaphragms, in a state where the rotor, the pair of bearing portions, the pair of seal portions, and the plurality of diaphragms, are not fixed and not integrated with each other.

2. The suspending tool according to claim 1, further comprising:

a vertical position adjusting portion that is configured to adjust positions of the pair of bearing supporting portions in the vertical direction with respect to the suspending tool main body.

* * * * *